US005169517A

United States Patent [19]

Buisson et al.

[11] Patent Number: 5,169,517

[45] Date of Patent: Dec. 8, 1992

[54] PROCESS FOR THE TREATMENT OF PETROLEUM FRACTIONS CONTAINING METALS, IN THE PRESENCE OF SOLID PARTICLES, INCLUDING A MAGNETOHYDROSTATIC SEPARATION STAGE FOR THE SAID PARTICLES AND THE RECYCLING OF PART OF THEM

[75] Inventors: André Buisson, Tassin la Demi Lune; Jean-Paul Euzen, Dardilly; Frédéric Morel, Sainte Foy les Lyon, all of France

[73] Assignee: Institut Francais du Petrole, Rueil Malmaison, France

[21] Appl. No.: 561,581

[22] Filed: Aug. 2, 1990

[30] Foreign Application Priority Data

Aug. 2, 1989 [FR] France ..... 89 10515

[51] Int. Cl.[5] ..... C10G 17/00; C10G 17/04

[52] U.S. Cl. ..... 208/251 H; 502/5; 502/21; 209/20; 209/24; 208/52 CT; 208/253; 208/251 R

[58] Field of Search ..... 208/251 H; 502/5, 21; 209/20, 24

[56] References Cited

U.S. PATENT DOCUMENTS

| | | | |
|---|---|---|---|
| 2,786,047 | 3/1957 | Jones et al. | 209/214 |
| 3,575,293 | 4/1971 | Nelson | 209/214 |
| 3,583,560 | 6/1971 | Cline | 209/214 |
| 4,021,367 | 5/1977 | Gal et al. | 502/21 |
| 4,087,004 | 5/1978 | Nott et al. | 209/214 |
| 4,342,640 | 8/1982 | Lewis | 209/214 |
| 4,526,681 | 7/1985 | Friedlander et al. | 209/214 |
| 4,530,291 | 7/1985 | Wyok | 209/214 |
| 4,594,149 | 6/1986 | Andres et al. | 209/214 |
| 4,643,822 | 2/1987 | Parsonage | 209/214 |
| 4,819,808 | 4/1984 | Andres et al. | 209/214 |

*Primary Examiner*—Helane Myers

*Attorney, Agent, or Firm*—Antonelli, Terry, Stout & Kraus

[57] ABSTRACT

Process for the treatment of a hydrocarbon fraction containing metals and comprising the following stages: (a) the said hydrocarbon fraction is treated in the presence of mean density particles ($d_o$) under conditions for eliminating at least partly the metals contained therein and deposits of said metals on at least one fraction of said solid particles; (b) at least part of the solid particles from stage (a), whose mean density is ($d_i$) is drawn off; (c) said solid particles from stage (b) are magnetohydrostatically separated by introducing said solid particles into a ferrofluid placed in a non-uniform magnetic field and creating a vertical magnetic field, whose intensity is adjusted in such a way that the apparent mean density ($d_{af}$) of the ferrofluid permits the separation of said solid particles into at least one mean density fraction ($d_i$) below said apparent mean density ($d_{af}$) of the ferrofluid and into at least one mean density fraction ($d_s$) above said mean apparent density ($d_{af}$) of the ferrofluid and above the mean density ($d_1$) of the solid particles drawn off in stage (b); (b) at least one fraction of said mean density solid particles ($d_s$) is recovered; and (e) recycling takes place to stage (a) of at least one fraction of said mean density solid particles ($d_i$). The solid particles preferably comprise particles of a catalyst and the treatment is e.g. a hydrotreatment.

10 Claims, No Drawings

PROCESS FOR THE TREATMENT OF PETROLEUM FRACTIONS CONTAINING METALS, IN THE PRESENCE OF SOLID PARTICLES, INCLUDING A MAGNETOHYDROSTATIC SEPARATION STAGE FOR THE SAID PARTICLES AND THE RECYCLING OF PART OF THEM

The present invention relates to a process for the treatment of hydrocarbon fractions containing metals. It more particularly relates to a multistage process having at least one treatment stage of a hydrocarbon fraction containing metals in the presence of solid particles under conditions of eliminating at least partly the metals contained therein and deposits of said metals on at least one fraction of said solid particles, at least one magnetohydrostatic separation stage of part of the solid particles and at least one recycling stage of a fraction of said solid particles to the treatment stage of said fraction.

During heat treatments or hydrotreatments of hydrocarbon fractions containing metals performed in the presence of solid particles and preferably including solid particles of at least one catalyst, it is well known both in the case of a catalytic treatment and in a non-catalytic treatment, that the properties of the solid particles gradually deteriorate over a period of time as a result of the deposition of coke and the metals contained in the charge. Although there are numerous methods for regenerating solid particles, they are usually methods permitting the more or less complete elimination of the coke and it is generally not possible without significant modifications to the properties of the solid particles to eliminate the metals which are deposited during the treatment. It is therefore necessary to replace at least part of the solid particles on which the metals have been deposited by new solid particles, i.e. which have not been in contact with the hydrocarbon fraction under the conditions of the treatment. The deposition of the metals on the solid particles is never uniform, neither axially, nor radially, so that it is necessary to reject the solid particles, certain of which still have theoretically adequate properties to continue to fulfil their function in the envisaged treatment. This non-uniformity of the deposits of metals on the solid particles can have a number of causes. For example, in the case of a treatment carried out in a fixed or moving bed, it can be at least partly due to a poor distribution of the charge, whilst in the case of a treatment in a boiling or entrained bed it can be at least partly due to a more or less complete mixture of the solid particles in the reaction zone, which leads to the drawing off of solid particles which have not been in contact with the hydrocarbon charge.

French patent application FR-A-2 484 439, which specifically relates to a catalytic cracking process, describes a method for separating a catalyst which has been removed from the circulation in a fluidized bed catalytic cracking unit into a fraction containing metals and a fraction not containing metals. According to this patent application it is possible to separate by means of a high field gradient magnetic field, the catalyst particles into magnetic particles and nonmagnetic particles. However, according to this method it is necessary to use a very high field gradient (p. 8, lines 19–21 of said patent application), which involves the use of special equipment and therefore very high capital costs. In addition, said method is not applicable in the case where the metals which are deposited on the solid particles are in the form of metallic compounds having no significant magnetic properties. Moreover, e.g. in the case of a catalytic hydrotreatment of a hydrocarbon charge in the presence of a supported catalyst incorporating at least one metal chosen in the group formed by metals of groups (VIB and VIII of the periodic classification of elements (Handbook of Chemistry and Physics, 55th Edition, 1974/5, inside cover page), the difference in the magnetic properties between the particles of the new catalyst, i.e. which have not been contacted with the hydrocarbon charge under the hydrotreatment conditions and the spent catalyst particles, i.e. which have been in contact with the hydrocarbon charge under the hydrotreatment conditions, is relatively small, which is a significant handicap for the effective separation of said particles into a still active fraction which will be recycled and a fraction which has become inactive or has a very low residual activity and which will be eliminated.

The present invention aims at obviating the disadvantages of the prior art and at proposing a process making it possible to obviate the rejection of solid particles still having the requisite properties for the envisaged treatment. The process according to the present invention also has the advantage of being applicable both in the case of using new solid particles not containing metals and in the case where at least part of the new solid particles contains metals. In both the envisaged cases, the present process makes it possible to separate, following the use of the solid particles by contacting them with the hydrocarbon charge under the envisaged conditions of the treatment, at least one fraction of said particles no longer having the requisite properties for said treatment and at least one fraction whose properties are still considered to be adequate for them to be advantageously recycled to the hydrocarbon charge treatment stage.

More specifically, the present invention relates to a process for the treatment of a hydrocarbon fraction containing metals, which is characterized by the following stages:

a) said hydrocarbon fraction is treated in the presence of mean density solid particles $d_o$ under conditions of at least partly eliminating the metals contained therein and deposits of said metals on at least one fraction of said solid particles;

b) at least part of the solid particles from stage a), whose mean density is $d_l$ is drawn off;

c) said solid particles from stage b) are magnetohydrostatically separated on the basis of their density difference or their magnetic property and density difference by introducing said solid particles into a ferrofluid placed in a non-uniform magnetic field and by creating a vertical magnetic field gradient, whose intensity is adjusted in such a way that the apparent mean density $d_{af}$ of the ferrofluid permits the separation of said solid particles into at least one means density fraction $d_l$ below said mean apparent density $d_{af}$ of the ferrofluid and into at least one mean density fraction $d_s$ above said apparent mean density $d_{af}$ of the ferrofluid and above the mean density $d_l$ of the solid particles drawn off in stage b)

d) at least one fraction of said mean density solid particles $d_s$ is recovered, which is above the apparent mean density $d_{af}$ of the ferrofluid and the mean density $d_l$ of the solid particles drawn off in stage b); and e) recycling takes place to the hydrocarbon fraction treatment stage a) of at least one fraction of said solid particles of mean density $d_i$ below the apparent mean density $d_{af}$ of the ferrofluid and above the mean density $d_l$.

During the treatment in stage α7), the particles are charged with metals, so that the mean density of the particles passes from an initial value $d_o$ to another value $d_l$ in excess of $d_o$ and which is a function of the nature and the quantity of the metals deposited on said particles.

The term apparent mean density $d_{af}$ is used throughout the present description to designate the mean value of the apparent density in the presence of a magnetic field measured at each point of a vertical axis substantially in the centre of the apparatus. The apparent density at a point defined by the relation $\rho_a = \rho_f + M x \nabla H x g^{-1}$ in which $\rho_a$ is the apparent density of the ferrofluid, $\rho_f$ is the physical density of the ferrofluid in the absence of any magnetic field other than the earth's magnetic field, M is the magnetization intensity of the ferrofluid, ∇H the vertical magnetic field gradient and g the acceleration of gravity.

The hydrocarbon fractions which it is intended to treat in stage a) of the present process are those which generally contain a quantity of metals which is normally at least 1 ppm (part per million) and is e.g. 1 to 3000 ppm and usually 5 to 2000 ppm. These fractions can be conventional crude petroleum residues, residues resulting from atmospheric distillation or vacuum distillation of crude petroleums, heavy oils or extra-heavy oils, or their residues, e.g. oils from the Fara Petrolifera field in Venezuela or the Athabasca field in Canada. The most commonly found metals in the hydrocarbon charges which are normally treated according to the process of the present invention are nickel and vanadium. Certain charges also contain non-negligible quantities of other metals, e.g. iron, copper and even mercury.

The present invention envisages both a catalytic and a non-catalytic treatment of the hydrocarbon charge. Thus, the present process is applicable in all cases where, during the treatment of the hydrocarbon charge containing metals, at least part of said metals is deposited on at least part of the solid particles with which the charge comes into contact under the treatment conditions. As non-limitative examples of the treatments envisaged by the present invention reference can be made to catalytic cracking, hydrotreatments and in particular hydrodemetalization and processes for the trapping of the mercury contained in liquid or gaseous hydrocarbon fractions with the aid of solid trapping materials.

The treatments are carried out in fixed, mobile, entrained, fluid or boiling beds. The process according to the invention can be applied with particular advantage in the case of treatments in mobile, entrained, fluid or boiling beds. In the particular case of catalytic treatments, the hydrocarbon charge is contacted with solid particles in the form of the particles of at least one catalyst. The catalyst can be a mineral solid having a catalytic action in the envisaged treatment process and not containing metals, such as is e.g. the case with zeolites or silica-aluminas used in catalytic cracking or a metal catalyst e.g. resulting from the deposition of metals on a solid support, e.g. a standard catalyst used in hydrotreatments including at least one metal chosen from the group formed by metals of groups VIB and VIII of the periodic classification of elements on a support, normally a mineral support and e.g. an alumina or silica-alumina.

The new solid particles used in stage a) have a mean initial density $d_o$ which progressively increases during contact with the hydrocarbon charge under the treatment conditions as a result of the deposition on at least part of them of the metals contained in the charge. When there is found to be a reduction in the performance characteristics of the treatment, at least part of the solid particles which, as a result of their contact with the hydrocarbon charge, have a mean density $d_l$ above the initial mean density $d_o$ is continuously or periodically (intermittently) drawn off. In a preferred embodiment of the invention, these mean density particles $d_l$ undergo a combustion treatment under conditions making it possible to eliminate most of the coke contained therein and which has deposited during stage a) of the treatment, before being sent to the hereinbefore described magnetohydrostatic separation stage c). During the latter the intensity of the magnetic field and its direction are chosen in such a way that the ferrofluid has a mean apparent density $d_{af}$ differing from its density in the absence of any magnetic field, other than the earth's magnetic field and which is normally equal to a value of approximately $0.5xd_l$ to approximately $1.5xd_l$ and which is preferably approximately 0.8 to approximately $1.2xd_l$. This mean value $d_{af}$ is chosen so as to permit the separation of the mean density solid particles $d_l$ into at least one mean density fraction $d_i$ below the mean apparent density $d_{af}$ of the ferrofluid and at least one mean density fraction $d_s$ above said mean apparent density $d_{af}$ of the ferrofluid and the mean density $d_l$ of the solid particles drawn off in stage b). Thus, it is possible to carry out a sorting or separation of the solid particles from stage b) as a function of their density and/or their density and their magnetic properties into several fractions by varying the value of the mean apparent density $d_{af}$ of the ferrofluid. Then, for each value chosen for said mean apparent density, a fraction of particles with a mean density above said densities is obtained, together with a fraction having a mean density below said density. The fraction or fractions whose mean density is still relatively close to the mean density value $d_o$ of new solid particles still have adequate properties to enable them to be very advantageously recycled, optionally after washing and drying in order to eliminate any ferrofluid traces, to hydrocarbon fraction treatment stage a). In an advantageous variant of the present process, at least one first fraction of solid particles with a mean density $d_i$ is separated from at least one second fraction of solid particles with a mean density $d_s$, whose value is higher by at least 10% than the mean density value $d_i$ of said first fraction, said value $d_s$ normally being higher by at least 11% and preferably at least 15% than the mean density value $d_o$ of new solid particles.

The ferrofluid used for carrying out the sorting or separation of the solid particles during stage c) of the present process is normally a stable or stabilized suspension of fine colloidal particles of at least one ferromagnetic solid, which is e.g. an oxide, such as iron (II, III) oxide $Fe_3O_4$ or magnetite, in the form of particles with average dimensions of approximately $5\times10^{-9}$ to approximately $2\times10^{-8}$ m (approximately 50 to 200 Angströms), in an organic or aqueous solvent and usually in an organic solvent, which is normally a hydrocarbon or hydrocarbon mixture liquid at normal temperature and pressure. Examples of hydrocarbons or hydrocarbon mixtures are xylene and kerosene. These suspensions are usually stabilized by means of at least one surfactant, such as e.g. an oleic or linoleic acid or acid derivative. The ferromagnetic solid particle concentration within the liquid is normally approximately 1 to approximately 10% by weight. The density, measured at 20° C. based on water at 4° C., of the ferrofluid in the absence of any magnetic field other than the earth's magnetic field is normally approximately 0.8 to approximately 1.30. The mean apparent density $d_{af}$ obtained during the application of the magnetic field gradient can be above or below the density of the ferrofluid in the absence of an external magnetic field. It is below if the vertical magnetic field gradient applied is directed upwards, i.e. in the direction opposite to the force of gravity and is below if the magnetic field gradient is directed downwards, i.e. in the same direction as the force of gravity.

The ferrofluid used normally has a saturation magnetization intensity of approximately $10^{-4}$ to approximately 1 Tesla and is usually approximately $10^{-2}$ to approximately $5\times10^{-2}$ Tesla. The magnetic field gradient along the height of the pole pieces is normally approximately $10^5$ $Axm^{-2}$ (ampere per square meter) to approximately $10^8$ $Axm^{-2}$ and is usually $2\times10^5$ $Axm^{-2}$ to approximately $2\times10^6$ $Axm^{-2}$. The mean apparent density of the ferrofluid can thus be adjusted to values varying e.g. from approximately 0.5 to approximately 25. The process of the present invention is applicable no matter what the shape and size of the solid particles. The size of the solid particles is normally approximately $10^{-6}$ to approximately $10^{-2}$ m and usually approximately $5\times10^{-6}$ to approximately $5\times10^{-3}$ m.

The temperature of the solid particles supplied to the magnetohydrostatic separation stage c) is preferably below the boiling point, under normal pressure and temperature, of the ferrofluid used. This stage is usually performed at normal or ambient temperature and pressure, although it is also possible to operate under a pressure above or below ordinary pressure.

The combustion stage of the coke which has been deposited on the solid particles during the treatment is a conventional stage whose conditions are well known to the Expert. For example, the elimination of most of the coke contained on the solid particles can be carried out by contacting these particles with a gas containing oxygen by progressively increasing the temperature until there is an exothermic coke combustion or burning reaction, normally at between 300° and 500° C. This combustion is preferably carried out with precautions and the operating conditions are adjusted in such a way that preferably the temperature does not exceed 550° C. and in a more preferred manner 500° C. During this combustion stage most of the coke is burnt in such a way that the weight content of residual coke in the solid particles after combustion is normally below approximately 5% of the coke content of the solid particles before combustion (i.e. at least 95% of the coke has been burnt). The gas containing oxygen in the combustion stage is normally a mixture of oxygen and inert gas, which conventionally contains 0.1 to 30% by weight of oxygen and usually 0.2 to 10% by weight of oxygen. This gas can e.g. be air or air diluted by an inert gas, e.g. nitrogen. The oxygen proportion in the gas used for coke combustion can also be varied as a function of the evolution of the exothermic combustion reaction. It is e.g. lower on starting and then can be progressively or incrementally increased on approaching the end of said stage.

The equipment used for carrying out the separation of the solid particles as a function of their density difference or as a function of their magnetic property and density difference is of a conventional nature and can e.g. be of the type used during the separation by settling of ores from nonferrous metals. The equipment used will not be described in detail here and reference can e.g. be made for descriptions of such equipment and to the way in which they are used to the AIAA Paper No. 73-959 "3rd Urban Technology Conference and Technical Display, Boston, Mass., Sep. 25-28, 1973" by L. MIR, C. SIMARD and D. GRANA entitled "Recovery of nonferrous metals from scrap automobiles by magnetic fluid levitation", pp. 1 to 7; in the documentation of the 15th Mineralurgy Congress 1985, 1, pp. 307 to 316 by M. S. WALKER, A. L. DEVERNOE, R. W. STUART, W. S. URBANSKI and U. ANDRES entitled "A new method for the commercial separation of particles of differing densities using magnetic fluid - the MC process"; and in Physics in Technology, vol. 15, 1984, pp. 150 to 156 by J. POPPLEWELL entitled "Technological applications of Ferrofluids".

In the case of catalytic treatments the present process makes it possible to maintain the catalytic activity at a high level by replacing the particles very highly charged with metals and recovered in stage d) of the process by particles of new catalyst mixed with the solid particle fraction containing only small amounts of metals and recycled to stage a) of the process.

The following examples illustrate the invention without limiting its scope. Example 1 is given for comparison purposes.

Example 2 relating to the performance of the process according to the invention in the case of a hydrodemetalization of a hydrocarbon fraction with the aid of a commercially available catalyst, reveals the important advantages of the process and in particular the possibility of carrying out an effective separation of catalytic particles with a low residual activity as a result of a large deposition of metals, without it being necessary to use special, onerous equipment of the type used in the process described in French patent application FR-A-2 484 439, which suffers from the high costs for the equipment and the energy involved in operating the same.

EXAMPLE 1 (COMPARISON)

A hydrodemetallization takes place of a crude Venezuelan Boscan petroleum charge, which has been headed and desalted and whose characteristics are given in the following table 1. The test is carried out in a pilot plant operating with 1000 $cm^3$ of catalyst in a boiling bed reactor. The operating conditions are chosen in such a way that the initial demetalization activity is 75%. The catalyst used is in the form of solid particles with an average size of $1.6\times10^{-3}$ m consisting of 14% by weight molybdenum (VI) oxide $MoO_3$ and 3% by weight nickel (II) oxide NiO on an alumina support. The catalyst is of a commercial nature and is solid by PROCATALYSE. The mean density of the solid particles of this new catalyst is 0.85. When the demetalization activity has dropped to 10%, a periodic drawing off of a spent catalyst fraction takes place and is replaced by new catalyst, so as to maintain the demetalizing activity at a value of at least 65%. The drawing off of the spent catalyst and its replacement by new catalyst is continued under these conditions until the distribution of the ages of the solid particles of the catalyst and therefore the mean density $d_l$ of said solid particles is subject to no further evolution over time. As from this state of equilibrium a periodic drawing off takes place of 100 $cm^3$ of solid particles with a mean density $d_l$ equal to 2 and they are replaced by the same quantity of new catalyst. Thus, the demetalizing activity is maintained substantially constant over a period of time at a mean value equal to approximately 65%.

TABLE 1

| | | |
|---|---|---|
| Density at 20° C. | 1.0 | |
| Viscosity at 100° C. | 198 | $mm^{+2}xs^{-1}$ |
| Viscosity at 70° C. | 1111 | $mm^{+2}x^{-1}$ |
| Total sulphur | 5.2% | by weight |
| Total nitrogen | 5500 | ppm by weight |
| Nickel | 96 | ppm by weight |
| Vanadium | 1043 | ppm by weight |
| Conradson carbon | 15.9% | by weight |
| ASTM D 1160 distillation | | |
| Initial point | 229° C. | |
| 40% point | 508° C. | |

EXAMPLE 2

Example 1 is repeated until the state of equilibrium is reached and from the latter a periodic drawing off takes place with the same periodicity as that used in example 1, namely 150 $cm^3$ of solid catalyst particles with a mean density $d_l$ of 2 and they undergo a coke combustion treatment under atmospheric pressure. The gaseous mixture used for carrying out the combustion is a mixture containing dry air and nitrogen in a proportion such that the oxygen content of the mixture is 1% by weight. The temperature is progressively increased until the start of coke combustion occurs and the flowrate of the gaseous mixture is then regulated in such a way that the temperature at which the coke burns does not exceed approximately 450° C. The injection of the gaseous mixture is continued until the temperature again drops to a value below 300° C. and then the solid catalyst particles are cooled to ambient temperature (22° C.). The solid catalyst particles no longer containing coke are then suspended in a ferrofluid containing 6% by weight of magnetite in kerosene. The density of the ferrofluid used in this example is, in the absence of any magnetic field other than the earth's magnetic field, 0.95. The equipment used in this example is constituted by a plastic container, which is open to the top and which contains the ferrofluid. It is placed between the poles of an electromagnet, whose magnetic field intensity is regulated in such a way as to adjust the mean apparent density $d_{af}$ of the ferrofluid to a value of 2. Thus, on the surface of the ferrofluid is recovered a solid particle fraction (approximately 50% by volume, i.e. approximately 75 $cm^3$) of mean density $d_i$ equal to 1.5 and at the bottom of the container a solid particle fraction (approximately 50% by volume) of mean density $d_s$ equal to 2.5. The mean density fraction $d_i$ is recycled, after washing with toluene and drying, mixed with an equal quantity of new catalyst to the demetalization reactor. Thus, the hydrometalization treatment of the charge can be continued without any significant modification of the demetalization performance characteristics, which are maintained substantially constant over time at an average value of 65%.

Thus, the process according to the present invention leads to a substantial economy (approximately 25% by volume) of new catalyst without any significant modification to the demetalization performance characteristics. Moreover, the solid particle fractions of mean density $d_s$ covered in the process according to the invention represent, for a given quantity of metals from the treated charge, a smaller volume than in the case where the catalyst is systematically replaced by new catalyst, which is a supplementary advantage of the process when it is wished to retreat spent catalyst either with a view to a possible reuse, or with a view to its destruction in order to avoid any pollution of the environment, or with a view to recovering the metals deposited on the catalyst.

we claim:

1. Process for the treatment of a hydrocarbon fraction containing metals, which is characterized by the following stages:

a) said hydrocarbon fraction is treated in the presence of solid particles of a mean density $d_o$ under conditions of at least partly eliminating the metals contained therein and forming deposits of said metals on at least one fraction of said particles;

b) at least part of the solid particles from stage a), whose mean density is $d_l$ is drawn off;

c) said solid particles from stage b) are magnetohydrostatically separated on the basis of their density difference by introducing said solid particles into a ferrofluid placed in a non-uniform magnetic field and by creating a vertical magnetic field gradient, whose intensity is adjusted in such a way that the apparent mean density $d_{af}$ of the ferrofluid, which is defined by the relation $\rho_a=\rho_f+Mx\nabla Hxg^{-1}$ in which $\rho_a$ is the apparent density of the ferrofluid, $\rho_f$ is the physical density of the ferrofluid in the absence of any magnetic field other than the earth's magnetic field, M is the magnetization intensity of the ferrofluid, $\nabla H$ the vertical magnetic field gradient and g the acceleration of gravity, permits the separation of said solid particles into at least one first fraction of mean density $d_i$ below said mean apparent density $d_{af}$ of the ferrofluid and into at least one second fraction of mean density $d_s$ above said apparent mean density $d_{af}$ of the ferrofluid and above the mean density $d_l$ of the solid particles drawn off in stage b), the mean density value $d_s$ being higher by at least 10% than the mean density value $d_i$ of said first fraction, and being higher by at least 11% than the mean density value $d_o$ of new solid particles;

d) at least one fraction of said mean density solid particles $d_s$ is recovered, which is above the apparent density $d_{af}$ of the ferrofluid and the mean density $d_l$ of the solid particles drawn off in stage b); and e) recycling takes place to the hydrocarbon fraction treatment stage a) of at least one fraction of said solid particles of mean density $d_i$ below the apparent mean density $d_{af}$ of the ferrofluid and above the mean density $d_l$.

2. Process according to claim 1, wherein stage a) is a hydrotreatment stage.

3. Process according to claim 1 or claim 2, wherein the solid particles comprise particles of at least one catalyst.

4. Process according to claim 3, wherein the at least one catalyst is a supported catalyst comprising at least one metal selected from the group consisting of metals of Groups VIB and VIII of the periodic classification of elements.

5. Process according to claim 1 wherein the treatment of the hydrocarbon fraction is performed in a moving bed, an entrained bed, a fluidized bed or a boiling bed.

6. Process according to claim 1, wherein the solid particles drawn off in stage b) undergo a combustion treatment under conditions making it possible to eliminate most of the coke contained therein before being supplied to stage c).

7. Process according to claim 1, wherein use is made of a ferrofluid formed by a stable colloidal suspension of fine particles with average dimensions of approximately $4\times10^{-9}$ to approximately $2\times10^{-8}$ m of at least one ferromagnetic oxide in an organic or aqueous solvent.

8. Process according to claim 7 in which the ferromagnetic oxide particle concentration is approximately 1 to 10% by weight.

9. Process according to claim 1, wherein the ferrofluid has a saturation magnetization intensity of approximately $10^{-4}$ to approximately 1 Tesla and the magnetic field gradient along the height of the pole pieces is approximately $10^5$ to approximately $10^8$ $Axm^{-2}$.

10. Process according to claim 9, wherein said ferrofluid comprises a stable colloidal suspension of fine particles with average dimensions of approximately $4\times10^{-9}$ to approximately $2\times10^{-8}$ m of at least one ferromagnetic oxide in an organic or aqueous solvent.

* * * * *